US005180161A

United States Patent [19]

Jordan

[11] Patent Number: 5,180,161

[45] Date of Patent: Jan. 19, 1993

[54] EXERCISE MACHINE

[76] Inventor: Brett M. Jordan, 1453 Algona Dr., North Canton, Ohio 44720

[21] Appl. No.: 419,108

[22] Filed: Oct. 10, 1989

[51] Int. Cl.[5] ..... A63B 21/00

[52] U.S. Cl. ..... 482/143

[58] Field of Search ..... 272/134, 144, 145, DIG. 4; 125/25 R, 70–75; 269/322–328

[56] References Cited

U.S. PATENT DOCUMENTS

| | | | |
|---|---|---|---|
| 4,292,962 | 10/1981 | Krause | 272/145 X |
| 4,391,443 | 7/1983 | Beecroft | 272/145 |
| 4,620,701 | 11/1986 | Mojden | 272/144 X |
| 4,645,205 | 2/1987 | Wolff | 272/134 X |
| 4,669,724 | 6/1987 | Matheisen | 272/145 |
| 4,672,697 | 6/1987 | Schürch | 272/144 X |

FOREIGN PATENT DOCUMENTS

| | | | |
|---|---|---|---|
| 2854142 | 6/1980 | Fed. Rep. of Germany | 272/144 |

*Primary Examiner*—Robert Bahr

*Attorney, Agent, or Firm*—Renner, Kenner, Greive, Bobak, Taylor & Weber

[57] ABSTRACT

An exercise machine is provided with a pair of vertically adjustable support posts having a rod extending thereacross. A support plate for receiving the upper back portion of a user is fixedly secured to the rod, while a lower support plate is interconnected with the upper support plate through a universal joint which may be selectively locked into position or released to allow the lower support plate to swivel with respect to the upper plate. An appropriate gear reducer is connected to the rod to allow the rod to be rotated to position the user in a desired orientation.

15 Claims, 3 Drawing Sheets

EXERCISE MACHINE

TECHNICAL FIELD

The invention herein resides in the art of exercise apparatus and, more particularly, to a machine for exercising the lower back and abdomen, allowing for a broad range of stretches and exercises to this portion of the anatomy.

BACKGROUND ART

The health consciousness of society has given rise to the introduction and use of various types of exercise equipment. Such equipment spans a broad spectrum from individual implements and devices for home and office use, to the more complex machines employed in gyms, health clubs, and the like. Presently, such machines typically employ a combination of cams, gears, and levers, against which the user urges his physical forces to exercise and extend his muscles. While the prior art has been quite satisfactory for the purpose of exercising most muscles, it is known that the present exercise machines do not allow for adequate stretch and flexure of the abdominal area. Indeed, the prior art does not provide an effective "work out" for the abdomen and lower back. Proper strengthening, tone, and flexibility of these areas require both rotation and bending to greater degrees than previously attained. Indeed, the prior art tends to restrict the development of such flexibility by inhibiting rotation and bending while exercising these areas of the body, rather than encouraging it. Basically, the prior art exercises the abdomen and lower back by simply allowing the user to exert force in a very limited range of body flexure against a mechanism of pulleys, cams and levers. The limited degree of flexibility afforded the user of such devices does not provide the degree of flexibility necessary to attain proper exercising of the lower back and abdomen.

There is a need in the art for an exercise machine which provides great latitude in bending, flexing, and rotating at the abdomen and lower back. There is further a need for suspending the user and allowing him to exercise and flex his abdominal and lower back muscles through a broad range of movements, substantially unrestricted by the machine itself.

DISCLOSURE OF INVENTION

In light of the foregoing, it is a first aspect of the invention to provide an exercise machine which suspends the user and leaves the user substantially unrestrained for exercising.

Another aspect of the invention is the provision of an exercise machine which is adapted for adjustment to accommodate users of various heights.

Another aspect of the invention is the provision of an exercise machine which separately supports the upper and lower back and provides for relative rotational movement between said supports.

Still a further aspect of the invention is the provision of an exercise machine wherein interconnected supporting surfaces are adjustable to accommodate different physiques to allow proper support placement between the upper and lower back.

Yet an additional aspect of the invention is the provision of an exercise machine which allows for positional adjustment of the user in exercising positions varying about a horizontal axis.

Still a further aspect of the invention is the provision of an exercise machine which is sturdy and durable in construction, and both safe and reliable in use.

The foregoing and other aspects of the invention which will become apparent as the detailed description proceeds are achieved by an exercise machine, comprising: a pair of vertical supports posts; a rod horizontally extending between said support posts; an upper support plate connected to said rods; and a lower support plate adjustably connected to said upper support plate.

Other aspects of the invention are attained by an exercise machine, comprising: a pair of vertical post, adjustable in height; a rod interconnecting said posts, said rod being rotatable about a longitudinal axis; a first support plate fixedly connected to said rod and rotatable therewith; and a second support plate in selective positional interconnection with said first support plate.

DESCRIPTION OF DRAWINGS

For a complete understanding of the objects, techniques and structure of the invention reference should be made to the following detailed description and accompanying drawings wherein.

BEST MODE FOR CARRYING OUT THE INVENTION

Figure 1:
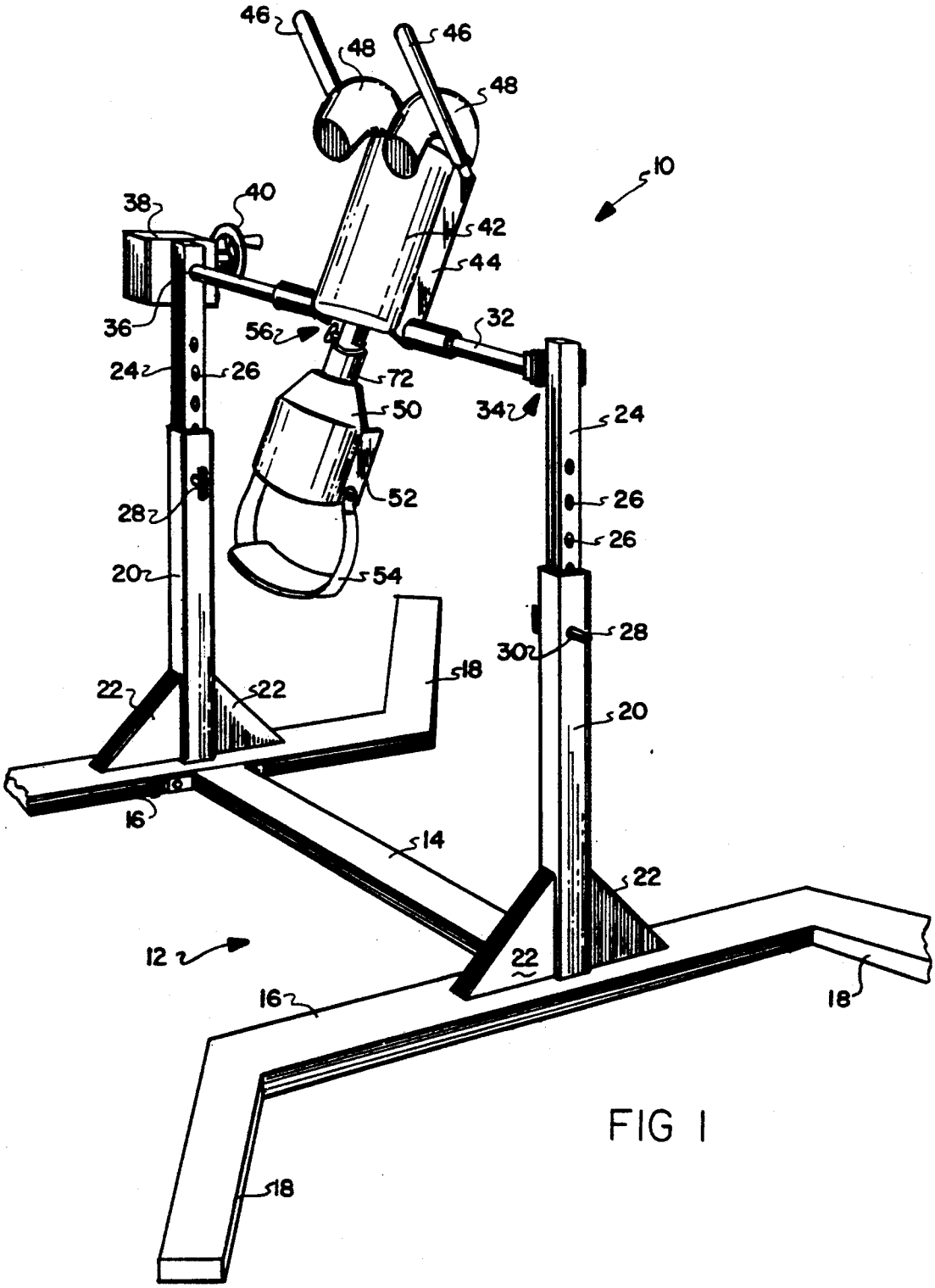
FIG. 1 is a perspective view of the exercise machine of the invention.
Figure 2:
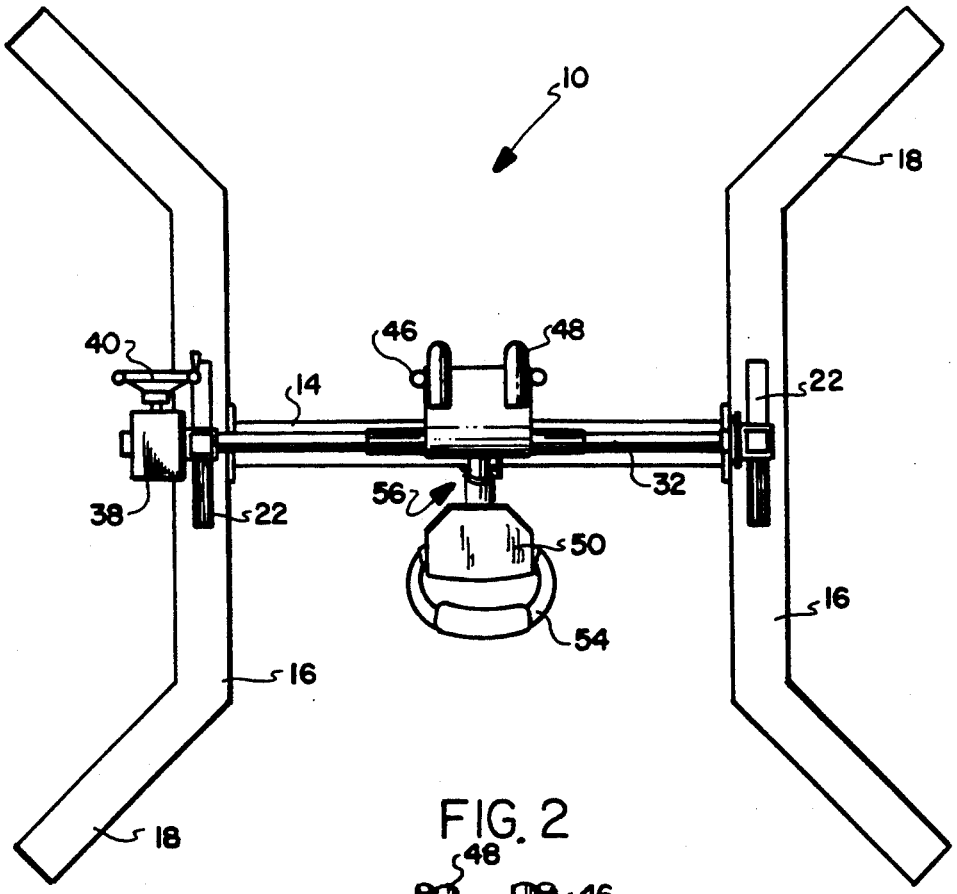
FIG. 2 is a top plan view of the exercise machine of the invention.
Figure 3:
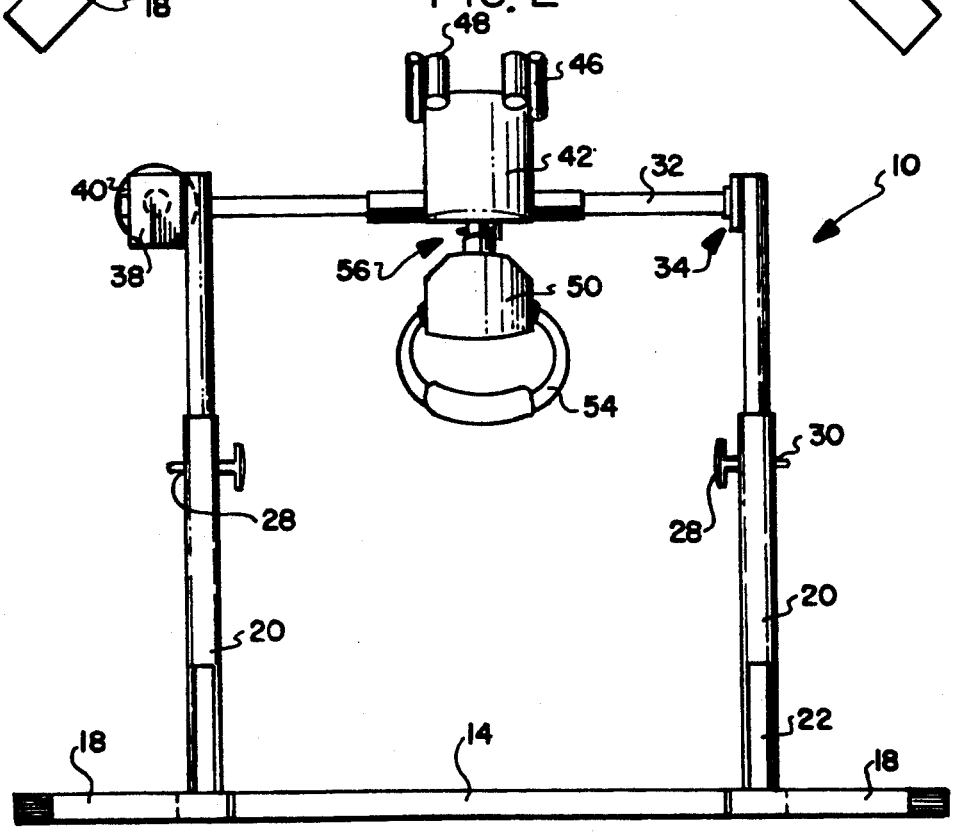
FIG. 3 is a front elevational view of the exercise machine of the invention.

Referring now to the drawings and more particularly FIGS. 1-3, it can be seen that an exercise machine according to the invention is designated generally by the numeral 10. As shown, a base 12 consists of a lateral bar 14 orthogonal to and interconnecting side bars 16, each of which has an end bar 18 at each end thereof. The end bars 18 are preferably angled outwardly and away from the axis of the lateral bar 14 to provide feet for the base 12, adding stability to the machine 10.

A pair of tubular columns 20, preferably square in cross-section, extend upwardly to the center of each of the side bars 16 and in alignment with the longitudinal axis of the lateral bar 14. A pair of support flanges 22 are associated with each of the tubular columns 20, providing lateral support therefore by interconnecting the associated tubular columns 20 to the associated side bar 16. A support post 24 is telescopically received by each of the tubular columns 20. Each of the support posts 24 has a plurality of evenly spaced adjustment holes 26 passing therethrough. It will be appreciated that the holes in each of the support posts 24 are horizontally aligned with the corresponding holes in the other support post. Support pins 28 are adapted to pass through holes 30 within the tubular columns 20 and through the aligned holes 26 in the support posts 24 to maintain the support posts 24 at a desired height.

A rod 32, solid or tubular dependent upon the load bearing characteristics required, extends between the support posts 24. The rod is interconnected at one end thereof to a fafnir flange 34 which, as is known to those skilled in the art, constitutes a bearing maintained within a swivel socket. This type of bearing accommodates flexure or deflection in the rod 32 while still allowing the rod to rotate about its longitudinal axis without binding or the like.

The opposite end of the rod 32 passes through a hole 36 within the support post 24 and is received by a Morse reducer or other appropriate gear reducer. As is well known to those skilled in the art, a worm gear or other appropriate mechanism is controlled by a crank 40 with an appropriate mechanical advantage such that a fixed number of turns of the crank 40 will rotate the rod 32 one revolution about its central axis. In a preferred embodiment of the invention, for example, thirty turns of the crank 40 will result in a single revolution of the rod 32, providing a great mechanical advantage such that heavy loads on the rod 32 may be rotated.

An upper back support plate 42 is provided with a pair of side flanges 44 on each side thereof. Side flanges 44 are fixed by welding or other appropriate means to the rod 32. A pair of hand grips 46 extend obliquely from top corner portions of the upper back support plate 42 and are provided with appropriate padding or other non-slip covering to accommodate receipt of the user's hands. A pair of shoulder supports 48, arcuate in nature, also extend from top edges of the support plate 42 and are maintained between the hand grips 46. The spacing between the shoulder supports 48 is, in the preferred embodiment, sufficient to allow the head and neck of the user to be positioned therebetween so as to receive the shoulders of the user.

A lower back support plate or seat 50 is also provided with a pair of side flanges 52 on each side thereof. These side flanges, like the flanges 44, serve to strengthen and reinforce the respective plates 50, 42. A safety belt 54 interconnects the pair of side flanges 52 and is adapted for receiving and retaining a user in a fashion to be discussed hereinafter. A locking universal joint or pin and block connector 56 is provided to interconnect the top plate 42 with the bottom plate 50.

Figure 4:
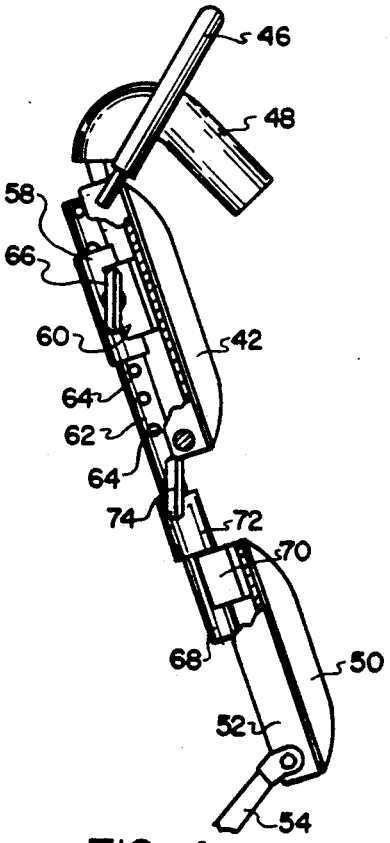
FIG. 4 is a side elevational view of the back support and seat of the invention showing the same locked together.
Figure 5:
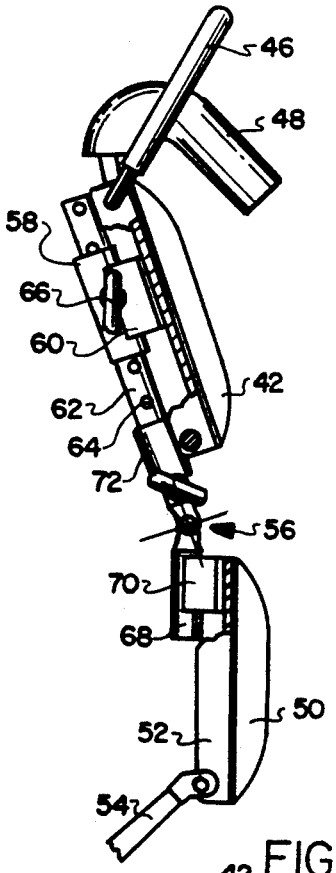
FIG. 5 is a side elevational view of the back support and seat of the invention in which the seat is adapted for rotation with respect to the back support.
Figure 6:
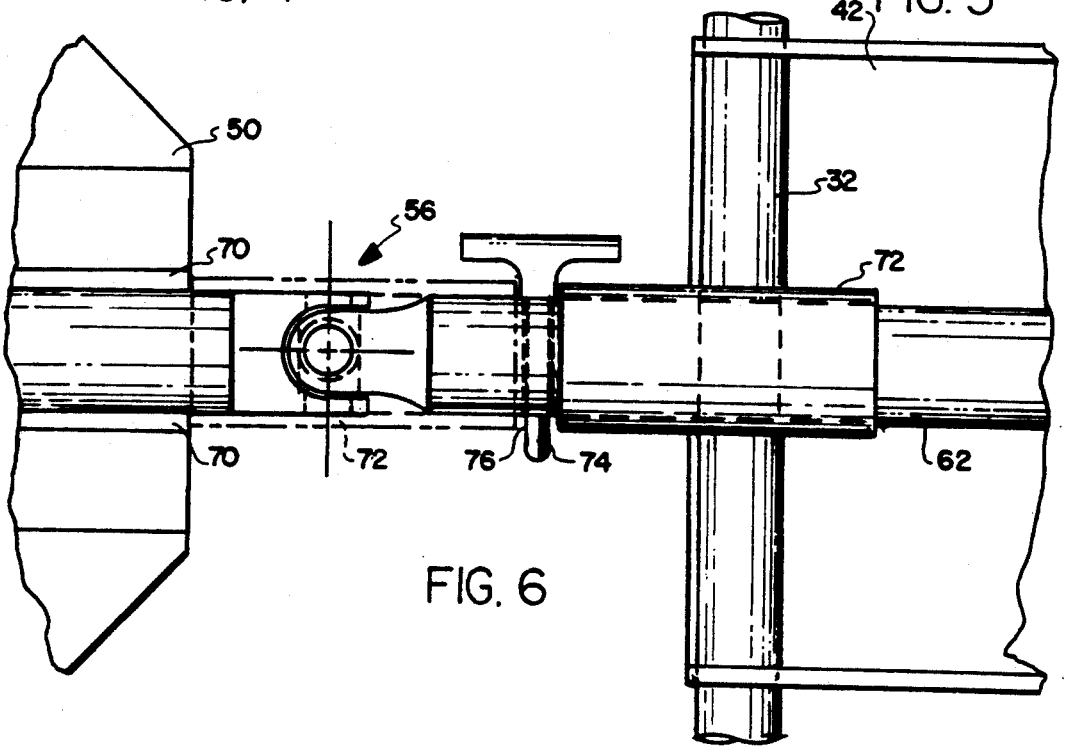
FIG. 6 is a partial sectional bottom plan view showing the interconnection between the back support and seat of the invention.

With reference now to FIGS. 4–6, it can be seen that a tube 58 is welded or otherwise affixed to the bottom of the plate 42 as by interconnection between a pair of plates 60 fixed to the top plate 42. A tube 62 is slidingly received within the tube 58 in telescopic relationship. A plurality of holes 64 pass through the tube 62 in uniformly spaced position therealong. A pin 66 is adapted to pass through a hole in the tube 58 and one of the holes 64 within the tube 62 to fixedly position the tube 62 within the tube 58, while allowing for subsequent adjustment.

As shown, a tube 68 is affixed between a pair of plates 70 which in turn is fixed to the bottom plate 50. A universal 56, as mentioned above, interconnects the tube 68 of the lower plate 50 with the tube 62 of the upper plate 42. The universal 56 allows the lower plate 50 to swivel or rotate about a pair of orthogonal axes during the exercising operation. Also provided is a locking sleeve 72 which is slidably received upon the tube 62. As can be seen, a pin 74 passes through a hole 76 in the tube 62 at the end thereof near the point of interconnection with the universal or pin and block connector 56. To allow the lower plate 50 to swivel with respect to the upper plate 42, the sleeve 72 is moved upwardly on the tube 62 and the pin 74 is then positioned in the hole 76 to prevent movement of the tube 72 over the universal 56. When it is desired that the plate 50 be locked in alignment with the plate 42, the universal connector 56 is straightened to align the tubes 62, 68 such that the sleeve 72 may fit over the universal 56. With it so positioned, the pin 74 is then inserted into the hole 76 to hold the sleeve 72 over the universal 56 and prevent any rotation thereof.

It will be readily appreciated by those skilled in the art that the material selected for implementation and construction of the invention will be chosen to satisfy the intended purpose. Typically, all of the structural elements will be of steel fabrication, interconnected by weldments and the like. As mentioned above, the rod 32 may be solid stock or tubular, and will be designed to support the weight of a user without flexure exceeding the limits of the fafnir flange 34. In any event, those skilled in the art of metal fabrication will readily perceive the parameters necessary for construction of a suitable structure.

With an appreciation of the physical structure of the invention, an appreciation of the operation can now be obtained. In use, with the pins 28 retracted from the holes 30, a user positions himself with his upper back against the upper plate 42 and with the shoulder supports 48 over his shoulders. With his hands on the hand grips 46, he then extends himself to a full upright position, at which time an assistant positions the pins 28 in the holes 30 to retain the support posts 24 at that elevation. The lower back portion or upper portion of the buttocks of the user is then positioned against the lower plate 50 with appropriate positioning of the plate 50 with respect to the plate 42 being achieved by means of the telescopic tube 62 received within the tube 58. With the lower plate 50 appropriately positioned, the pin 66 is appropriately inserted to engage with one of the holes 64 and retain the tube 62 in the appropriate position. At this time, the belt 54 may be strapped around the user for safety purposes.

To obtain the desired posture or elevational position of the user, an assistant may turn the crank 40 to rotate the assembly 42, 50 about the horizontal axis of the rod 32. With an appropriate mechanical advantage of the worm gear assembly 38, the smallest of assistants may rotate the largest of users.

With the user in the desired position, he may then exercise his lower back and abdomen by having the full lower portion of his body free from obstruction of the exercise machine itself. Bends, lifts, and rotation of the lower portion of the body at the abdomen and lower back may then be undertaken.

It will be appreciated that certain exercises will require that the lower plate 50 be held in fixed position with respect to the upper plate 42. In these instances, the locking sleeve 72 is positioned over the universal 56 to any swivel or rotation of the lower plate 50 with respect to the upper plate 42. Such a position is shown in FIG. 4. For those exercises in which relative pivoting and rotational movement of the lower plate 50 with respect to the upper plate 42 is desired, the sleeve 72 is removed from the universal 56 with the pin 74 retaining it in that position as shown in FIGS. 5 and 6. In such a situation, the lower body portion of the user may be twisted, turned, pivoted, and swiveled while still having support of the plate 50.

Of course, it will be understood that appropriate pads on the plate 42, 50, as well as the shoulder support 48, hand grips 46, and safety belt 54 all provide for user comfort and allow the user to exercise on the device without irritation.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breath of the invention reference should be made to the following claims.

What is claimed is:

1. An exercise machine, comprising:

a pair of vertical support posts;

a rod horizontally extended between said support posts;

and upper back support plate connected to said rod; a lower back support plate adjustably connected to said upper back support plate; and telescopic connection means for interconnecting said upper and lower back support plates in selective spaced apart relationship, said connection means comprising a universal connector, allowing said lower back support plate to swivel with respect to said upper back support plate.

2. The exercise machine according to claim 1, wherein said connection means further comprises locking means for selective engagement with said universal connector to lock said upper back support plate in fixed positional relationship with said lower back support plate.

3. The exercise machine according to claim 2, wherein said locking means comprises a sleeve selectively slidable onto said universal connector.

4. The exercise machine according to claim 1, wherein said telescopic connection means comprises a sleeve fixed to said upper back support plate, and a tube received within said sleeve and connected to said lower back support plate, said tube received within said sleeve and connected to said lower back support plate, said tube and sleeve having holes therethrough in selective registration, and a pin engaging said sleeve and tube through aligned pairs of said holes.

5. The exercise machine according to claim 1, wherein said rod is pivotally received at ends thereof by said pair of vertical support posts.

6. The exercise machine according to claim 5, further comprising means connected to a first end of said rod for rotating said rod about a longitudinal axis of said rod.

7. The exercise machine according to claim 6, wherein said means for rotating comprises a worm gear.

8. An exerciser machine according to claim 6, wherein said upper back support plates is fixed to said rod.

9. An exercise machine according to claim 1, wherein said vertical posts are telescopically adjustable.

10. An exercise machine, comprising:

a pair of vertical posts, adjustable in height;

a rod interconnecting said posts, said rod being rotatable about a longitudinal axis;

a first back support plate fixedly connected to said rod and rotatable therewith; and a second back support plate in selective positional interconnection with said first support plate and maintained on a side of said rod opposite said first back support plate; and connection means between said first and second back support plates allowing said second back support plate to swivel with respect to said first back support plate.

11. The exercise machine as recited in claim 10, wherein said connection means is telescopic, providing for selective separation between said first and second back support plates.

12. The exercise machine as recited in claim 10, further comprising a gear reducer connected to a first end of said rod for rotating said rod.

13. The exercise machine as recited in claim 12 further comprising a pair of shoulder supports extending from a top end of said first back support plate.

14. The exercise machine as recited in claim 13, further comprising a pair of rods extending from said top end of said first back support plate, said shoulder supports being within said pair of rods, said rods providing hand grips for a user.

15. The exercise machine as recited in claim 10, wherein said pair of vertical posts are telescopic and locked by pin interconnection between an outer sleeve and an inner post.

* * * * *